US011530819B2

(12) United States Patent
Acosta Herrero et al.

(10) Patent No.: US 11,530,819 B2
(45) Date of Patent: Dec. 20, 2022

(54) PAN SUPPORT, A GAS STOVE AND A METHOD FOR PRODUCING A PAN SUPPORT

(71) Applicant: BSH Hausgeräte GmbH, Munich (DE)

(72) Inventors: Luis Acosta Herrero, Maliaño (ES); Boris Angele, Diessen (DE); Christoph Becke, Grosskarolinenfeld (DE); Julia Ehrensberger, Munich (DE); Melca Gutierrez Humara, La Penilla (ES); Christian Hoisl, Munich (DE); Alberto Lopez Ortiz, Santander (ES); Luis Antonio Palacios Valdueza, Astillero (ES); Emilio Placer Maruri, Liencres (ES)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/047,081

(22) PCT Filed: Apr. 8, 2019

(86) PCT No.: PCT/IB2019/052877
§ 371 (c)(1),
(2) Date: Oct. 13, 2020

(87) PCT Pub. No.: WO2019/202433
PCT Pub. Date: Oct. 24, 2019

(65) Prior Publication Data

US 2021/0172608 A1 Jun. 10, 2021

(30) Foreign Application Priority Data

Apr. 18, 2018 (ES) ..... ES201830381

(51) Int. Cl.
*F24C 15/10* (2006.01)
*F23D 14/06* (2006.01)
(Continued)

(52) U.S. Cl.
CPC ..... *F24C 15/10* (2013.01); *F23D 14/06* (2013.01); *F24C 3/00* (2013.01); *F24C 3/085* (2013.01); *F24C 15/107* (2013.01)

(58) Field of Classification Search
CPC ..... F24C 15/10; F24C 15/107; F24C 3/00; F23D 14/06
(Continued)

(56) References Cited

U.S. PATENT DOCUMENTS 2,100,292 A * 11/1937 Schneider ..... F24C 3/085 126/39 H
4,313,416 A 2/1982 Lau
(Continued)

FOREIGN PATENT DOCUMENTS

CN 206958911 U 2/2018
JP 2005207668 A 8/2005

OTHER PUBLICATIONS

National Search Report ES P201830381 dated Jan. 18, 2019.
International Search Report PCT/IB2019/052877 dated Jun. 21, 2019.

*Primary Examiner* — Vivek K Shirsat
(74) *Attorney, Agent, or Firm* — Michael E. Tschupp; Andre Pallapies; Brandon G. Braun

(57) ABSTRACT

A pan support according to the invention for a gas stove comprises a support structure for a pan having a support surface for the pan, a chamber for a gas, in particular for an inflammable combustion mixture, the chamber being arranged in the interior of the support structure. Gas outlet openings are provided at the support structure and have a fluid connection to the chamber. The chamber has a circumferential geometry when looking from above.

15 Claims, 9 Drawing Sheets

(51) Int. Cl.
*F24C 3/00* (2006.01)
*F24C 3/08* (2006.01)

(58) Field of Classification Search
USPC ..... 126/39 E, 39 R, 39 N
See application file for complete search history.

(56) References Cited

U.S. PATENT DOCUMENTS

| | | | | |
|---|---|---|---|---|
| 2014/0345590 | A1 | 11/2014 | Bresolin et al. | |
| 2016/0201902 | A1* | 7/2016 | Cadima | F24C 3/085 126/39 E |
| 2016/0238256 | A1 | 8/2016 | Rasi et al. | |
| 2017/0082293 | A1 | 3/2017 | Bassetti et al. | |
| 2017/0108215 | A1 | 4/2017 | Yang | |
| 2017/0138605 | A1* | 5/2017 | Cadima | F23D 14/065 |
| 2018/0045406 | A1 | 2/2018 | Shi et al. | |

* cited by examiner

PAN SUPPORT, A GAS STOVE AND A METHOD FOR PRODUCING A PAN SUPPORT

CROSS-REFERENCES TO RELATED APPLICATIONS

This application is the U.S. National Stage of International Application No. PCT/IB2019/052877, filed Apr. 8, 2019, which designated the United States and has been published as International Publication No. WO 2019/202433 A1 and which claims the priority of Spanish Patent Application, Serial No. P201830381, filed Apr. 18, 2018, pursuant to 35 U.S.C. 119(a)-(d).

BACKGROUND OF THE INVENTION

The present invention relates to a pan support, a gas stove comprising such a pan support and a method for producing such a pan support.

Usually, gas stoves may comprise a top sheet and a gas burner arranged at a through-hole for the gas burner of the top sheet. The gas burner may comprise a gas valve for providing combustible gas provided from below the top sheet. The combustible gas may be mixed with primary air for providing an inflammable combustion mixture. This may occur in a mixing chamber arranged in the area below the top sheet. Further, the gas burner may comprise a burner lid having gas outlet openings for providing the inflammable combustion mixture. In particular, secondary air may be provided at the gas outlet openings above the top sheet.

Further, the gas stove may comprise a pan support. Such a pan support may be provided as a removable part, e.g. for facilitating cleaning the top sheet and/or the pan support itself. Usually, the pan support is provided only as a support structure for a pan which is only configured to hold the pan above the flames of the gas burner in operation. Further, the pan support and the gas burner usually are provided as separate components.

Furthermore, it may be a requirement to provide a pan support for a gas stove which is suitable for heating different kinds of pans. In particular, certain pan types may require a concentration of heat at the bottom of the pan, such pans are known as "woks". When using woks for cooking, for an efficient energy use, it is advisable to concentrate most of the heat in the central area of a burner. In particular, a wok has a small footprint compared to its size. Moreover, the small footprint of the wok may result in an unstable support at the pan support. At the same time pan supports should be suitable for pots and pans that have a flat bottom face.

BRIEF SUMMARY OF THE INVENTION

It is one object of the present invention to provide an improved pan support.

Accordingly, a pan support for a gas stove is provided. The pan support comprises a support structure for a pan having a support surface for the pan, a chamber for gas, e.g. an inflammable combustion mixture, the chamber being arranged inside the support structure, and gas outlet openings provided at the support structure and having a fluid connection to the chamber. The chamber has a circumferential geometry when looking from above.

In contrast to conventional pan supports, the gas outlet openings are arranged at the support structure such that the support structure also provides a gas burner. Thus, at least two functions are integrated into the pan support, namely serving as support for the pan and being a gas burner. For example, a separate gas burner or gas burner lid having gas outlet openings for only heating the pan is not required. Moreover, an individual and premium design may be provided. Furthermore, cleaning a top sheet is improved because obstacles, e.g. gas burners and the like, may be omitted. Preferably, the chamber comprises a decentralized pillar channel extending downwards when looking from above.

"Support surface" for the pan may imply that the pan is touching this surface when the pan is arranged on the pan support as designated. "Chamber" may refer a cavity inside the support structure. The chamber is surrounded by a material of the support structure.

In embodiments, the support structure consists of a solid material, e.g. formed by an additive manufacturing process. One can contemplate of a laser-sintering and/or industrial 3D printing process. Said manufacturing processes allow for complex forms made of integral materials.

"Inside the support structure" may be construed as being in the interior of the support structure, or that the chamber is enclosed by the material of the support structure.

The chamber can be implemented as a cavity in the support structure with an access hole at a surface of the support structure.

Further, the chamber may be a channel for the gas, e.g. being an inflammable combustion mixture and is configured to guide or conduct a stream of the inflammable combustion mixture towards the gas outlet openings. In particular, the chamber is gas tight when closing all outlets and inlets. For example, the "inflammable combustion mixture" may be a fuel gas or a mixture of fuel gas and air, in particular primary air.

In particular, the pan support comprises one or several ignition devices for igniting or lighting the inflammable combustion mixture. Preferably, the pan support is configured to provide flames at the gas outlet openings for heating the pan. In particular, the pan support is configured to support a weight of the pan including a content of the pan and has an appropriate fatigue strength. Preferably, the pan support may be made of metal. The pan may be every type of cookware, e.g. a wok, pan, pot, roaster or the like.

Comprising "gas outlet openings" can be construed as at least one or several gas outlet openings are provided. The gas outlet openings may be provided as holes in the support structure reaching the chamber. Preferably, a plurality of gas outlet openings is provided.

"When looking from above" means a top view in a state in which the pan support is arranged as designated in an installed position on or at the gas stove. This means a pan may be arranged from above on the pan support touching the support surface.

A "Circumferential geometry" may imply that the chamber and/or support structure surrounds at least partially a center point. The chamber and/or support may have a ring-like shape or a polygon shape. The chamber may have a curved shape or is kinked having a kinked portion. Preferably, the chamber is curved or kinked around a center of the pan support when looking from above. The "center" may be center of a pan support area when looking from above. In embodiments the chamber and/or support structure have a circular shape with a circumference.

According to an embodiment, the support structure encloses a space or volume and is configured to at least partially accommodate or receive a wok inside the space.

Preferably, the space is an inner space and the support structure serves as a receptacle for the wok. In particular, the inner space is barrier-free. This has the advantage that a stable wok support may be provided. Moreover, a heat distribution may be improved at the wok when heating the wok. "Wok" may mean a special Asian-style pan having a footprint which is smaller than the opening of the pan and having a side wall which tapers downwards. Preferably, the support structure has a closed geometry surrounding the inner space when looking from above. "Closed geometry may mean" that the support structure is ring shaped.

According to a further embodiment, the support structure has a circular, rectangular, hexagonal, or octagonal shape when looking from above.

This has the advantage that a high-quality design may be provided. Preferably, the support structure has a circular, hexagonal or octagonal inner contour and/or outer contour when looking from above. In particular, the chamber has a circular, hexagonal or octagonal shape when looking from above.

According to a further embodiment, the pan support comprises a pipe portion for receiving and/or mixing an inflammable combustion mixture, wherein the pipe portion protrudes downwards from the support structure.

This has the advantage that the inflammable combustion mixture may be conducted by means of the pan support from the area below the top sheet. Preferably, the pipe portion is arranged off-center from the support structure at the top sheet. The pipe portion can be formed at an edge of the support structure. In particular, exactly one, two, three or four pipe portions protrude downwards from the support structure.

Further, the protrusion may engage with a hole in the top sheet of a gas stove thereby fixing the pan support.

In embodiments, the pan support has downwardly protruding pins for coupling with corresponding recesses in a top sheet. The pins may be part of the pipe portion. The pins can also be formed by the pipe portions.

According to a further embodiment, the support structure comprises a ring portion and pillar portions.

Preferably the pipe and/or the pillar portions are arranged vertically.

This has the advantage that radial recesses may be provided and, thus, more air, in particular secondary air, may stream to the inner space. Preferably, the pillar portions are circle-ring segment shaped or arched shaped when looking from above. Alternatively, the pillar portions may be circle shaped or elliptical shaped when looking from above.

According to a further embodiment, the pillar portions protrude downwards and/or upwards from the ring portion.

This has the advantage that several design variations may be realized. Preferably, the pillar portions constitute a bottom of the support structure. In case of pillar portions protruding downwards from the ring portion, a visual floating effect of the ring portion may be achieved.

According to a further embodiment, the gas outlet openings are provided at the ring portion and/or the pillar portions.

Preferably, the chamber extends through the ring portion and at least one pillar portion. In particular, the chamber comprises a pillar chamber extending through the pillar portion.

According to a further embodiment, the chamber extends through the ring portion and the pillar portions.

Thus, a chamber having sufficient capacity may be provided.

According to a further embodiment, the gas outlet openings comprise inner gas outlet openings facing towards a center surrounded by the support structure and/or outer gas outlet openings which are averted from the center. The inner gas outlet openings may face radially inwards from the support structure while the outer gas outlet opening face radially outwards.

This has the advantage that radially inner flames and/or radially outer flames may be provided. Preferably, the inner gas outlet openings are dispersed at an inner circumference or contour of the support structure when looking from above. In particular, the outer gas outlet openings are dispersed at an outer circumference or contour of the support structure when looking from above. In particular, the inner and outer gas outlet openings are arranged at different heights. Preferably, the outer gas outlet openings are arranged higher than the inner gas outlet openings.

According to a further embodiment, the pan support comprises a first chamber for the inflammable combustion mixture provided inside the support structure and a second chamber for the inflammable combustion mixture provided inside the support structure. Preferably, the first chamber is separated from the second chamber in an isolated fashion. E.g. there is no direct communicative coupling between the first and the second chamber.

This has the advantage that e.g. different inflammable combustion mixture streams can be provided through one pan support. Preferably, the first chamber and the second chamber are configured to be supplied by different gas nozzles with fuel gas.

According to a further embodiment, the inner gas outlet openings are fluid connected with the first chamber and the outer gas outlet openings are fluid connected with the second chamber.

This may have the advantage that different flame intensities may be provided at the inner and outer gas outlet openings. Preferably, a wall is arranged between the first and the second chamber.

According to a further embodiment, the support surface for the pan comprises an inclined surface which is inclined relative to a horizontal plane.

This has the advantage that a contact surface with the wok may be increased. Preferably, the support surface also comprises a horizontal support surface.

Further, a gas stove comprising such a pan support is provided.

Preferably, the gas stove comprises two cooking zones. In particular, exactly one, three, four, five or even six cooking zones may be provided. Each cooking zone may comprise such a pan support. For example, a plurality of cooking zones may be dedicated to one top sheet.

According to an embodiment, the gas stove comprises a top sheet having a through-hole, wherein a pipe portion of the pan support protrudes at least partially into the through-hole.

Preferably, the top sheet may be made of glass and/or a glass ceramic. Alternatively, the top sheet may be made of metal, e.g. steel or the like. Preferably, the top sheet may be a one-piece or a monobloc element. In particular, the pan supports are arranged at or on the same top sheet.

Furthermore, a method for producing such a pan support is provided. The pan support is produced by means of 3D-printing, in particular selective laser melting.

3-D printing or 3D impression, particularly "Selective Laser Melting" (SLM) allows for producing metallic pieces by fusing metallic material particles using a printing laser. In this process, metal powder is fused layer by layer (build-up) with a laser beam. Alternatively, or additionally, conventional manufacturing processes as die-casting, stamping or hot forging may be used.

Moreover, a cooking zone comprising such a pan support is provided.

The embodiments and features described with reference to the pan support apply mutatis mutandis to the gas stove and the method for producing the pan support.

Further possible implementations or alternative solutions of the invention also encompass combinations—that are not explicitly mentioned herein—of features described above or below with regard to the embodiments. The person skilled in the art may also add individual or isolated aspects and features to the most basic form of the invention.

BRIEF DESCRIPTION OF THE DRAWINGS

Further embodiments, features and advantages of the present invention will become apparent from the subsequent description and dependent claims, taken in conjunction with the accompanying drawings, in which:

DETAILED DESCRIPTION OF EXEMPLARY EMBODIMENTS OF THE PRESENT INVENTION

Figure 1:
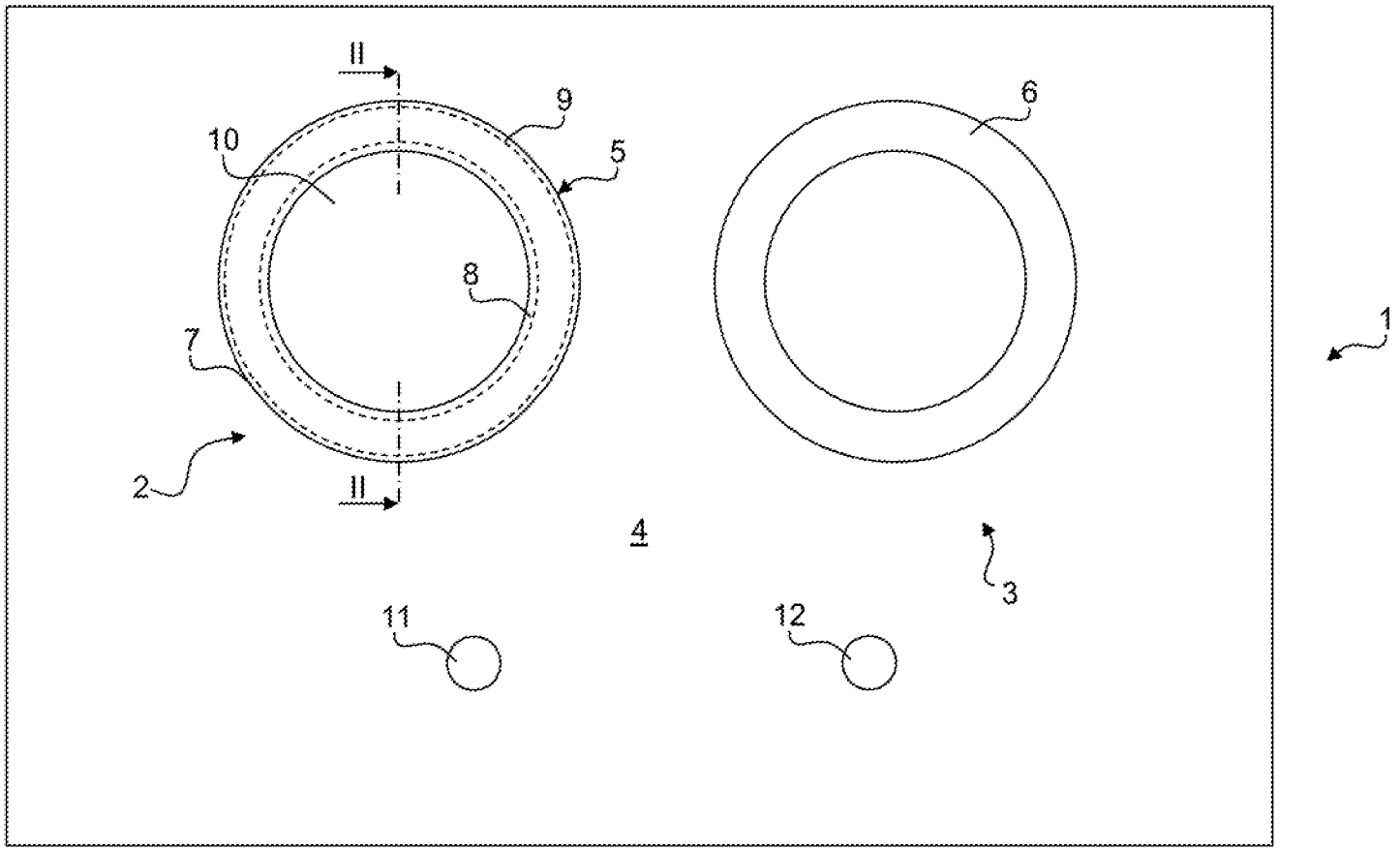
FIG. 1 shows a top view of one embodiment of a gas stove.

In the Figures, like reference numerals designate like or functionally equivalent elements, unless otherwise indicated.

FIG. 1 shows a top view of a gas stove 1. The gas stove 1 comprises two cooking zones 2, 3. In particular, only one, three, four, five or even six cooking zones may be provided (not shown). Further, the gas stove 1 comprises a top sheet 4 which, for example, may be made of glass and/or a glass ceramic. Alternatively, the top sheet 4 may be made of metal, e.g. steel or the like. Preferably, the top sheet 4 is a one-piece or a monobloc element. The top sheet 4 has a flat surface and includes only a few through-holes described below. Each cooking zone 2, 3 comprises an assigned pan support 5, 6. A pan support 5 and a pan support 6 may be identical or may have different sizes. In particular, the pan supports 5, 6 are arranged on the same top sheet 4. For example, a plurality of cooking zones 2, 3 may be dedicated to one top sheet 4.

The pan support 5 has a ring-like shape and comprises a support structure 7 for a pan 13 (see FIG. 2) having a support surface 8 for the pan 13, a chamber 9 (see broken lines) for an inflammable combustion mixture 20 (see arrows in FIG. 2) arranged inside the support structure 7. The pan 13 may be every type of cookware, e.g. a wok 14 (see FIG. 2). Further, gas outlet openings 15 (see FIG. 2) are provided which are arranged at the support structure 7 and which have a fluid connection to the chamber 9. The chamber 9 has a circumferential geometry when looking from above. The support structure 7 surrounds a volume or an inner space 10 and is configured to receive the wok 14 (see FIG. 2) partially inside the inner space 10. The wok 14 reaches into the volume 10 with its bottom 27. The volume 10 is free from structural elements, hence, no material is provided in the inner space 10. The inner space 10 is barrier-free. Preferably, the inner space 10 and the support structure 7 serve as a receptacle for the wok 14 (see FIG. 2).

The support structure 7 has a closed geometry when looking from above and is ring shaped, in particular circular ring shaped. Further, operating elements 11, 12 are provided for adjusting gas streams for the cooking zones 2, 3. In particular, the operating elements 11, 12 may be provided as rotary knobs. Preferably, the operating elements 11, 12 are centered at the designated positions at the top sheet 4 by means of magnets or magnetic discs (not shown). In particular, the operating elements 11, 12 are provided as removable elements such that a cleaning of the top sheet 4 is facilitated. It is an advantage of magnetically coupled knobs that no hole need to be drilled into the top sheet material. Hence, potentially spilled liquids cannot enter into the space below.

Integrating a gas burner into the pan support 5, 6 has the advantage that the number of components which have to be fixed at the top sheet 4 is reduced. Thus, the top sheet 4 is implemented with a reduced number of holes, projections or bosses. This simplifies the cleaning of the top sheet 4.

Further, the gas stove 1 or the pan support 5 may comprise one or several igniters (not shown). One can also contemplate of sensors, e.g. temperature sensors, flame sensors etc., integrated or attached to the pan support 5.

Figure 2:
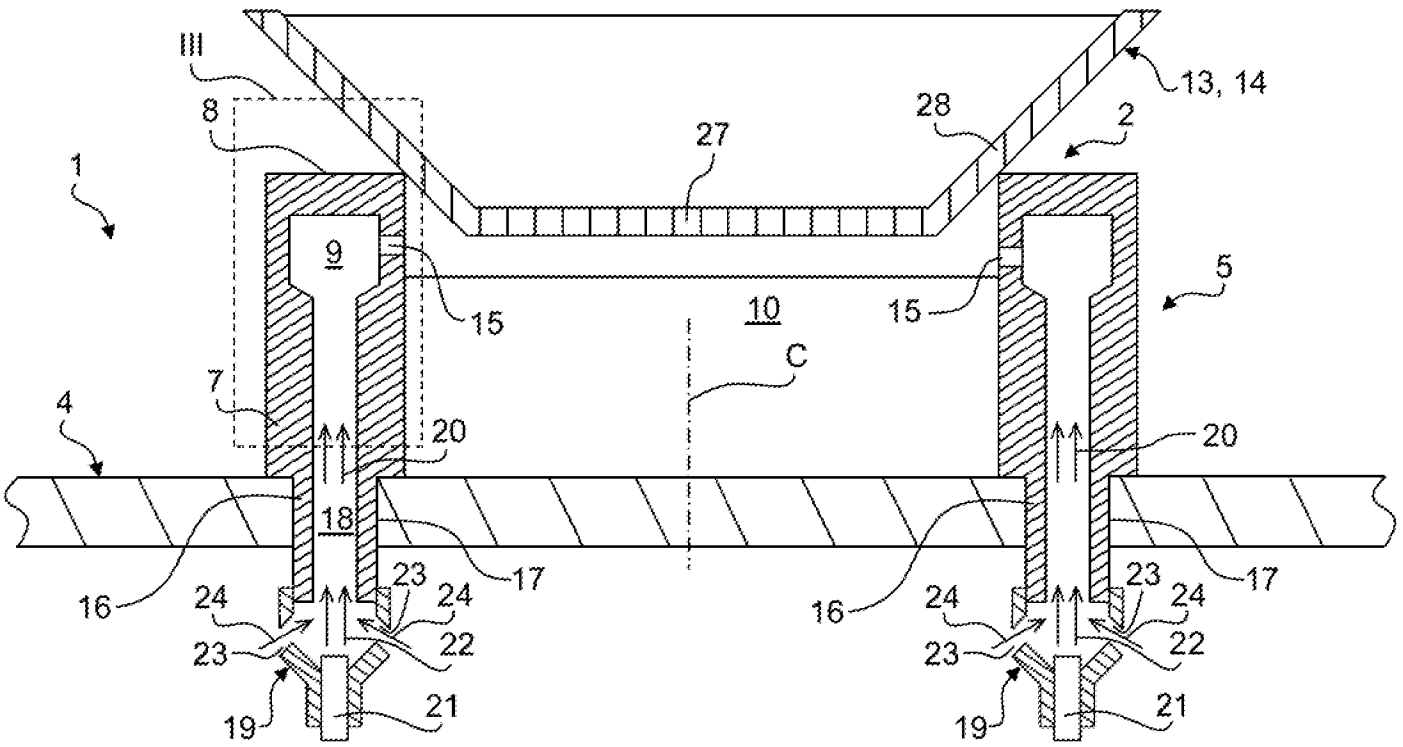
FIG. 2 shows a cross sectional view II-II from FIG. 1.

FIG. 2 shows a cross sectional view II-II from FIG. 1, wherein the section runs vertically through the gas stove 1. Further, a pan 13, in particular a wok 14, is arranged on the pan support 5. The wok 14 protrudes in part inside the inner space 10 such that a stable wok support is provided. Moreover, the gas outlet openings 15 are provided. The gas outlet openings 15 face inwards towards the center of the inner space 10, in particular a center point C is surrounded by the support structure 7. In particular, the gas outlet openings 15 are radial openings.

Moreover, the pan support 5 comprises a vertically arranged pipe portion 16 for receiving and/or mixing the inflammable combustion mixture 20. The pipe portion 16 protrudes downwards form the support structure 7 and runs through a through-hole 17 of the top sheet 4. The pipe portion 16 includes a channel 18 wherein the top portion of the channel 18 is fluid connected with the chamber 9. Further, the bottom portion of the channel 18 is fluid connected to a gas feeding device 19 for providing the inflammable combustion mixture 20. Preferably, the gas feeding device 19 comprises a gas nozzle 21 for providing fuel gas 22 (see arrows) and openings 23 for providing primary air 24 (see arrows). In particular, primary air 24 streams into the gas feeding device 19 where it is mixed with the fuel gas 22 generating the inflammable combustion mixture 20. Further, the inflammable combustion mixture 20 flows upwards into the channel 18 and then into the chamber 9. For example, the pipe portion 16 and the gas nozzle 21 may be seen as a Venturi nozzle. Preferably, the pipe portion 16 is arranged offset from the center of the structure when looking from above.

The pan support 5 may have two like pipe portions 16 protruding through the top sheet 4. Preferably, one cooking zone 2, 3 (see FIG. 1) has two gas feeding devices 19. Alternatively, the pan support 5 may have only one pipe portion 16. Preferably, the pipe portion 16 serves as a centering element. Additionally, the pipe portion 16 may serve as a fixing element fixing the pan support 5 at the top sheet 4, in particular, by means of fitting into the through-hole 17.

Figure 3:
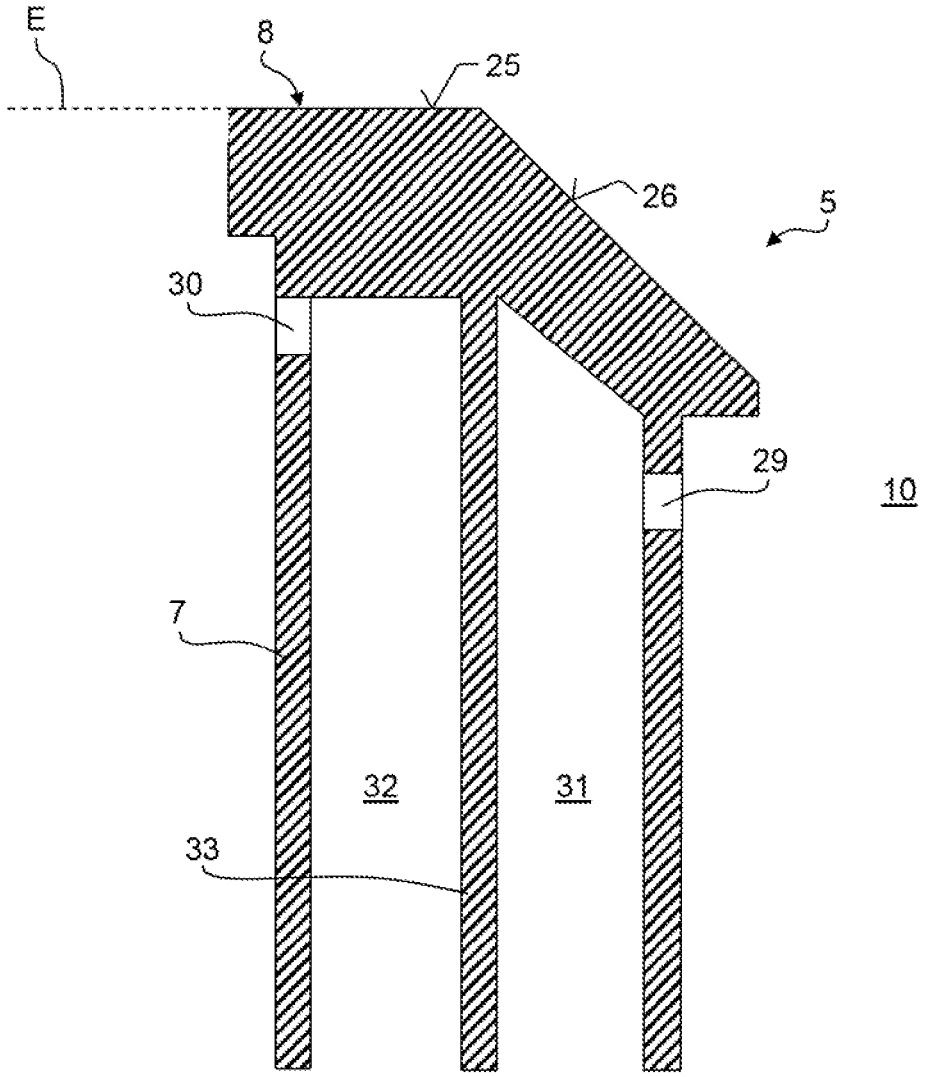
FIG. 3 shows detail view III form FIG. 2.

FIG. 3 shows detailed view of the area III in FIG. 2. The support surface 8 comprises a horizontal surface 25 configured to support a flat footprint 27 (see FIG. 2) of a pan 13 and an inclined surface 26 which is inclined relative to a horizontal plane E. In particular, the inclined surface 26 is configured to support an inclined wall 28 (tapered wall) (see FIG. 2) of the wok 14. Further, the pan support 5 comprises inner gas outlet 29 openings facing towards the center C (see FIG. 2) and/or the inner space 10 and outer gas outlet openings 30 which are averted from the center C and/or the inner space 10. For example, the inner and outer gas outlet openings 29, 30 may be arranged at different heights. The distribution of gas outlet openings 29, 30 facilitates an efficient heat production and transmission to the respective pan.

Further, a first chamber 31 for the inflammable combustion mixture 20 (see FIG. 2) is arranged inside the support structure 7, and a second chamber 32 for the inflammable combustion mixture 20 (see FIG. 2) is arranged inside the support structure 7 independent from the first chamber 31. Preferably, the first chamber 31 is separated from the second chamber 32 by means of a wall 33. For example, different inflammable combustion mixture streams may be provided to the first and the second chamber 31, 32. The inner gas outlet openings 29 are fluid connected with the first chamber 31. The outer gas outlet openings 30 are fluid connected with the second chamber 32. Alternatively, only one chamber instead of the first and the second chamber 31, 32 may be provided inside the pan support 5. In alternative embodiments, only the inner or the outer gas outlet openings 29, 30 may be provided.

In particular, the inner and outer gas outlet openings 29, 30 may be fluid connected with different gas nozzles 21 (see FIG. 2) (a dual gas circuit). Then, the inflammable combustion mixture 20 is fed through two different Venturi nozzles 21, each one feeding an independent chamber 31, 32. However, feeding each chamber 31, 32 through more than one Venturi nozzle 21 may be also possible. Thus, two different heat or flame intensities may be provided at the inner and outer gas outlet openings 29, 30. In another embodiment, two valves (not shown) are provided for controlling two different heat or flame intensities at one pan support 5.

For example, in a first step only the inner gas outlet openings 29 are supplied with the inflammable combustion mixture 20 (see FIG. 2) for heating e.g. a small pan 13, 14 or for keeping warm the pan 13, 14. In a second step, the outer gas outlet openings 30 are also supplied with gas for providing more heat e.g. for heating a bigger pan 13, 14. Thus, a switchover between the first and the second step may be provided when needed.

Alternatively, the inner and outer gas outlet openings 29, 30 may be fluid connected with different gas nozzles 21 (see FIG. 2) that are fluid connected to the same chamber 9 (single gas circuit). Then, the inflammable combustion mixture 20 is fed through two different Venturi nozzles 21 but the gas flow converges so that the gas fills the same chamber 9. However, feeding the chamber 9 by use of one Venturi nozzle 21 is also possible.

Figure 4:
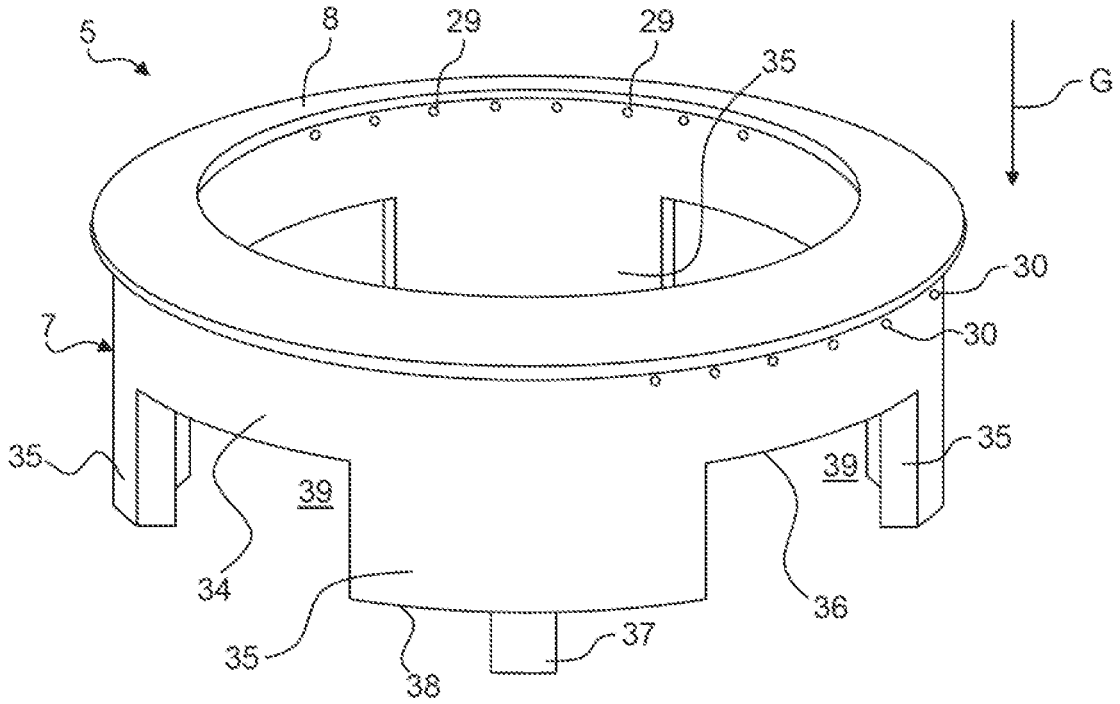
FIG. 4 shows schematically a perspective view of one embodiment of a pan support for a gas stove according to FIG. 1.

FIG. 4 shows a perspective view of an embodiment of a pan support 5, 6 for a gas stove 1 according to FIG. 1. The support structure 7 comprises a horizontal closed ring portion 34 and vertical pillar portions 35. In particular, the support structure 7 comprises four pillar portions 35 that each correspond to a section of the ring shape. The pillar portions 35 may be evenly distributed around a circumference 36 of the support structure 7. Recesses or void regions 39 are provided between the pillar portions 35. The pillar portions 35 protrude downwards from the ring portion 34. "Downwards" means that the pillar portions 35 protrude along gravity direction G. Preferably, the gas outlet openings 29, 30 are provided, in particular only, at the ring portion 34. In particular, the chamber 9, 31, 32 (not shown) extends in the ring portion 34 and in at least one of the pillar portions 35. Preferably, an igniter (not shown) is arranged at the pillar portion 35.

Preferably, the support surface 8 is formed by the upper face of the ring portion 34. The pillar portions 35 are circle-ring segment shaped or arc shaped. For example, the pillar portions 35 may constitute the bottom part of the support structure 7 that stands on the top sheet 4 (see FIG. 2). Alternatively, a further ring portion (not shown) formed at the pillar portions 35 may form a bottom portion of the support structure 7 such that the pillar portions 35 are arranged between two ring portions 34.

Further, a pin 37 may be provided at a bottom face 38 of the support structure 7. The pin 37 protrudes downwards from the support structure 7. The top sheet 4 may comprise a corresponding female portion or a further through hole (not shown) in which the pin 37 may be fitted. Preferably, the pipe portion 16 (see FIG. 2) and the pin 37 ensure a definite position of the pan support 5 relative to the top sheet 4. For example, the pan support 5 may comprise, in particular exactly, one or two pins 37 and one or two pipe portions 16. Pins 37 in combination with corresponding recesses in the top sheet 4 ensure a stable and fixed position relative to each other. Alternatively or additionally one can also contemplate of recesses in the pillar portions 35 and corresponding pins extending from the top sheet 4.

Figure 5:
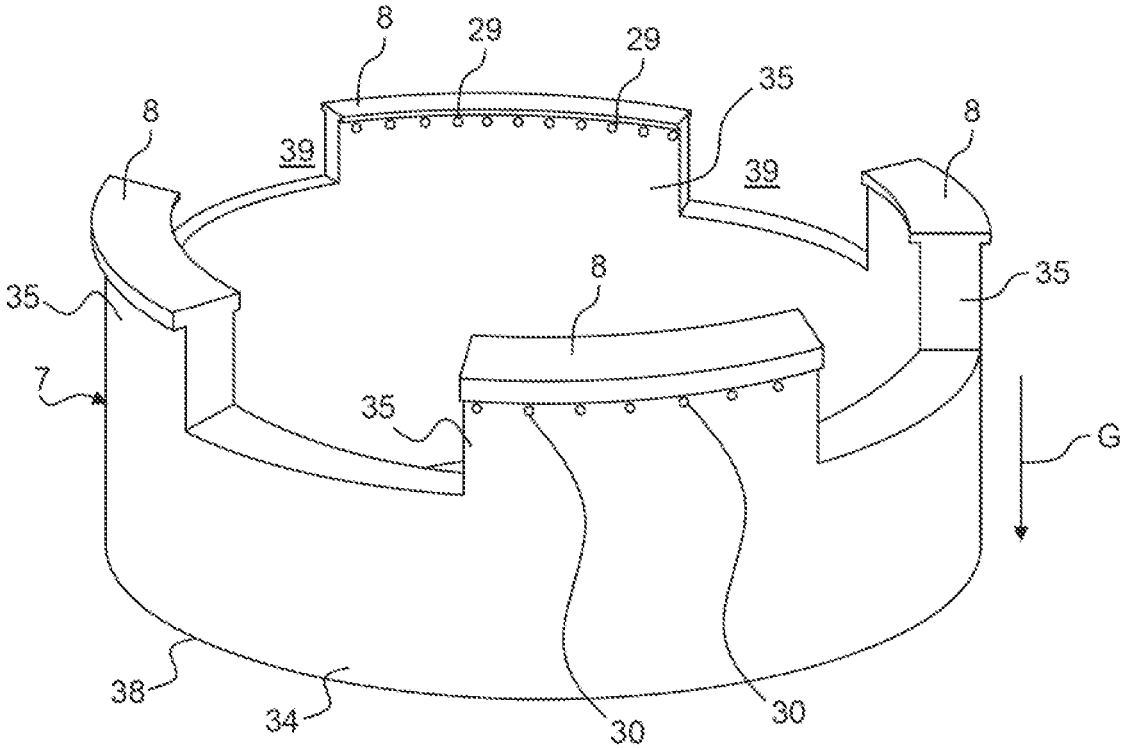
FIG. 5 shows schematically a perspective view of a further embodiment of the pan support for the gas stove according to FIG. 1.

FIG. 5 shows schematically a perspective view of a further embodiment of the pan support 5, 6 for the gas stove 1 according to FIG. 1. In contrast to FIG. 4, the pillar portions 35 protrude upwards (against the gravitational direction G) from the ring portion 34. Preferably, the pillar portions 35 form a top portion corresponding to the support structure 7. Further, the gas outlet openings 29, 30 are provided at the pillar portions 35.

Figure 6:
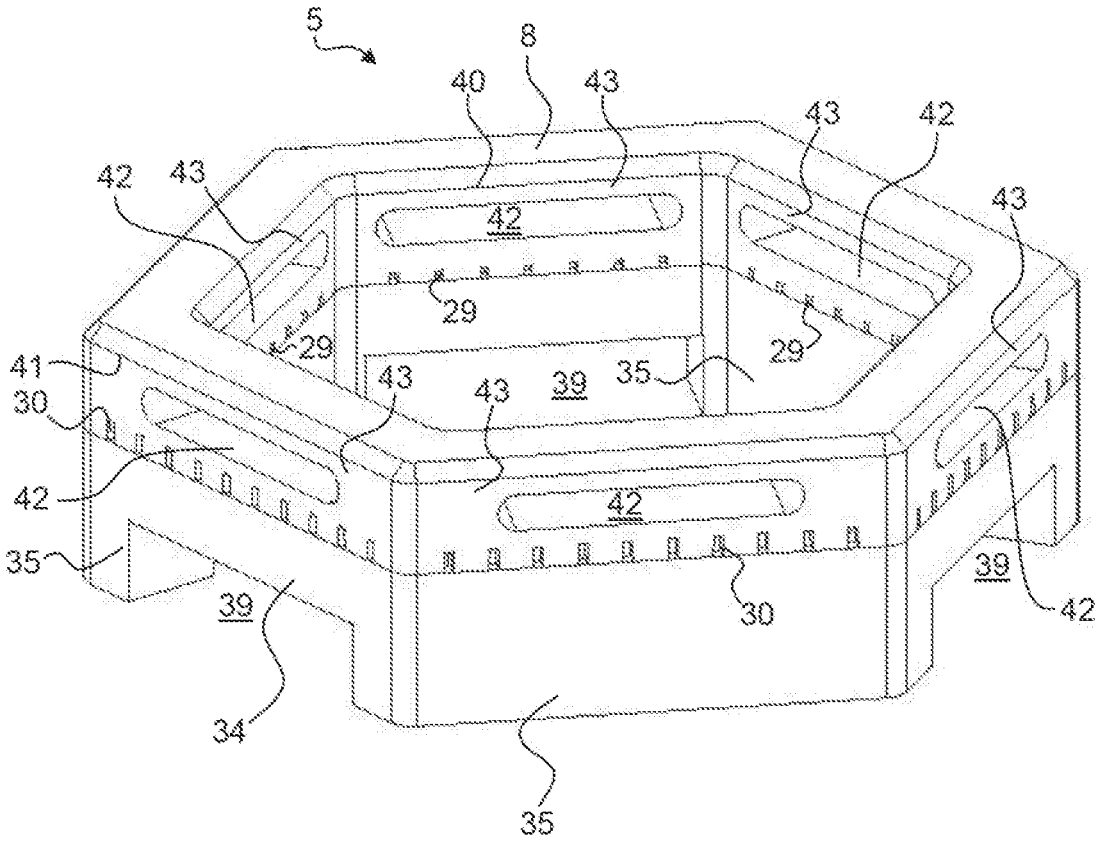
FIG. 6 shows schematically a perspective view of a further embodiment of the pan support for the gas stove according to FIG. 1.

FIG. 6 shows a perspective view of a further embodiment of the pan support 5, 6 for the gas stove 1 according to FIG. 1. In contrast to FIG. 4, the pan support 5 has a hexagonal shape when looking from above. Further, only three pillar portions 35 are provided. Between the pillars 35 or legs void regions 39 are provided to allow secondary air entering the central volume of the pan support 5. Preferably, an inner contour 40 and/or an outer contour 41 has a hexagonal shape when looking from above. Preferably, the gas outlet openings 29, 30 have a rectangular shape when looking in the respective opening. Alternatively, the openings may be round. Moreover, recesses 42, in particular radially extending recesses for providing secondary air, are provided at the ring portion 34. The hexagonal ring portion 34 comprises six straight segments 43 combined to form to the hexagonal shape. Preferably, every straight segment 43 comprises the recess 42. The recess 42 may be a radial trough-hole having an elongated shape in horizontal direction.

Figure 7:
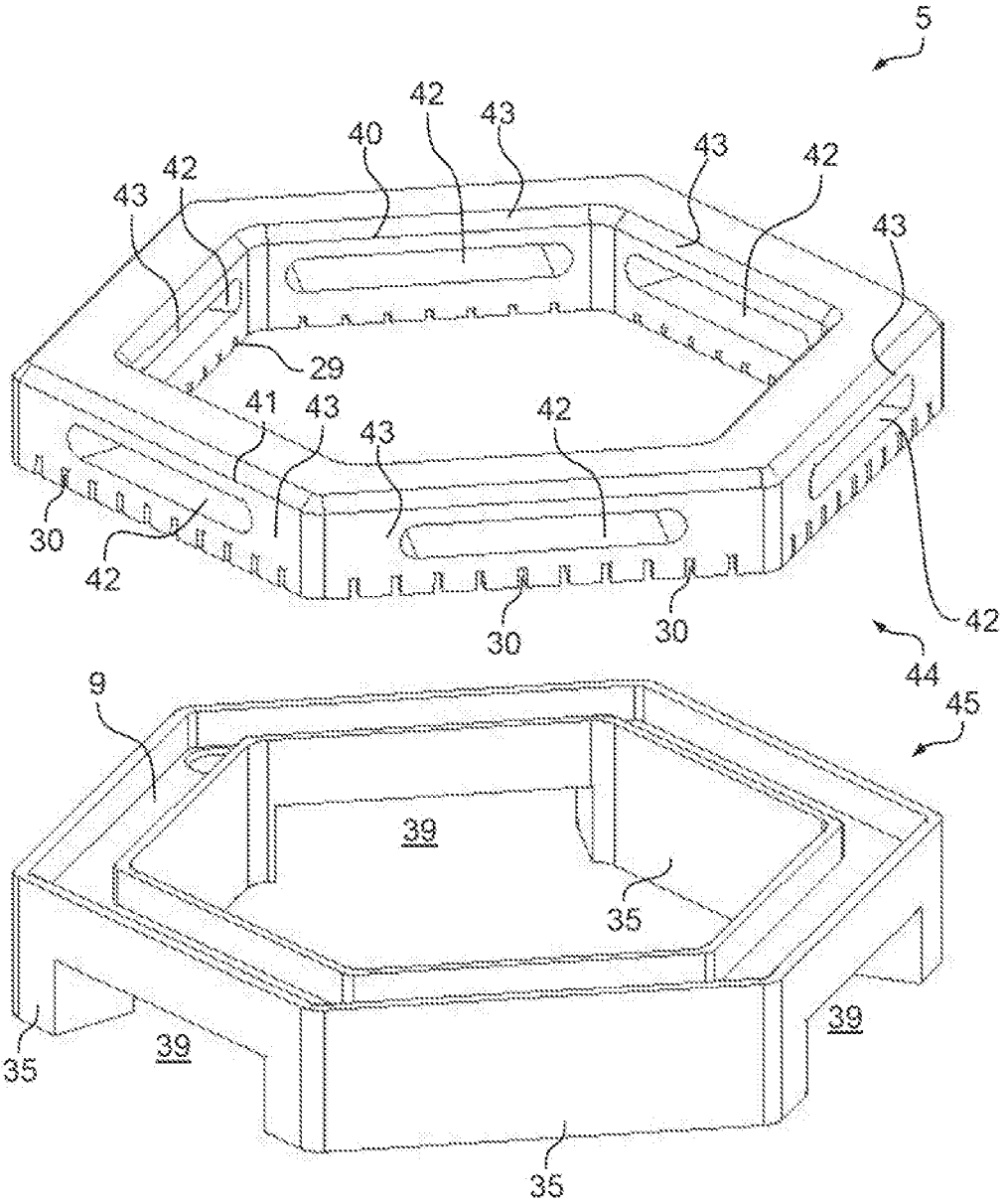
FIG. 7 shows schematically an explosive view of the pan support according to FIG. 6.

FIG. 7 shows schematically an explosive view of the pan support 5, 6 according to FIG. 6. For example, the support structure 7 may be separated into an upper ring portion 44 and a lower ring portion 45. Alternatively, the upper ring portion 44 and the lower ring portion 45 are provided fixedly connected to each other and/or as a one material piece or monobloc element. Preferably, the lower ring portion 45, comprises the pillar portions 35. In particular, the upper ring portion 44 is formed by the ring portion 34. Preferably, the upper ring portion 44 comprises the openings 29, 30 and the recesses 42. Preferably, the chamber 9 has a hexagonal shape when looking from above.

Figure 8:
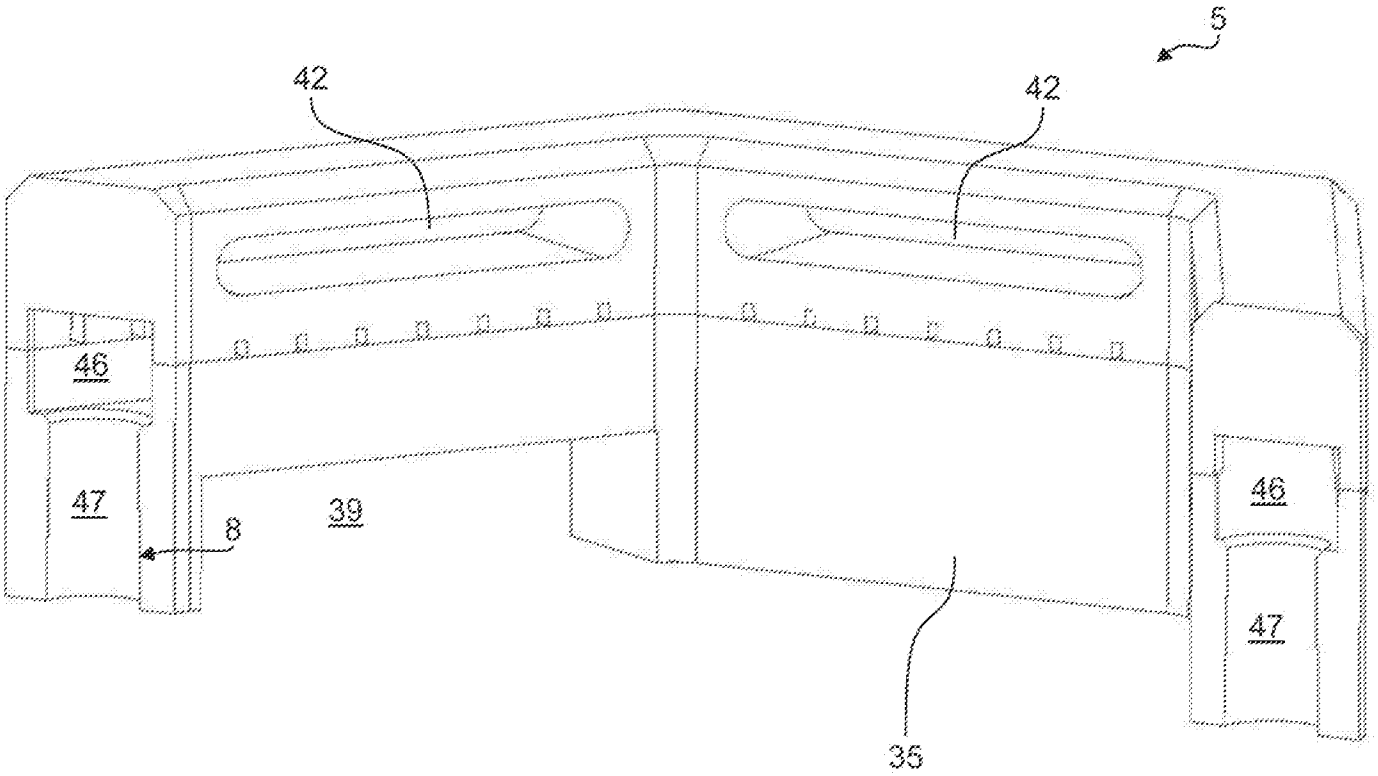
FIG. 8 shows schematically a cross sectional view of the pan support according to FIG. 6.

FIG. 8 shows schematically a cross sectional view of the pan support 4, 6 according to FIG. 6, wherein the section runs vertically through the pan support 5. The chamber 9 comprises a ring-shaped chamber 46, which in particular has a hexagonal shape when looking from above. Further, the chamber 9 comprises a pillar chamber 47 extending downwards from the ring-shaped chamber 46. The pillar channel 47 is at the outer circumference of the pan support 5 in an off-center position. The pillar channel 47 extends downwards in the direction to the top sheet 4. In particular, the chamber 9 comprises one, two, three or four of such pillar chambers 47. For example, the channel 18 (see FIG. 2) may be directly connected to the pillar chamber 47.

Figure 9:
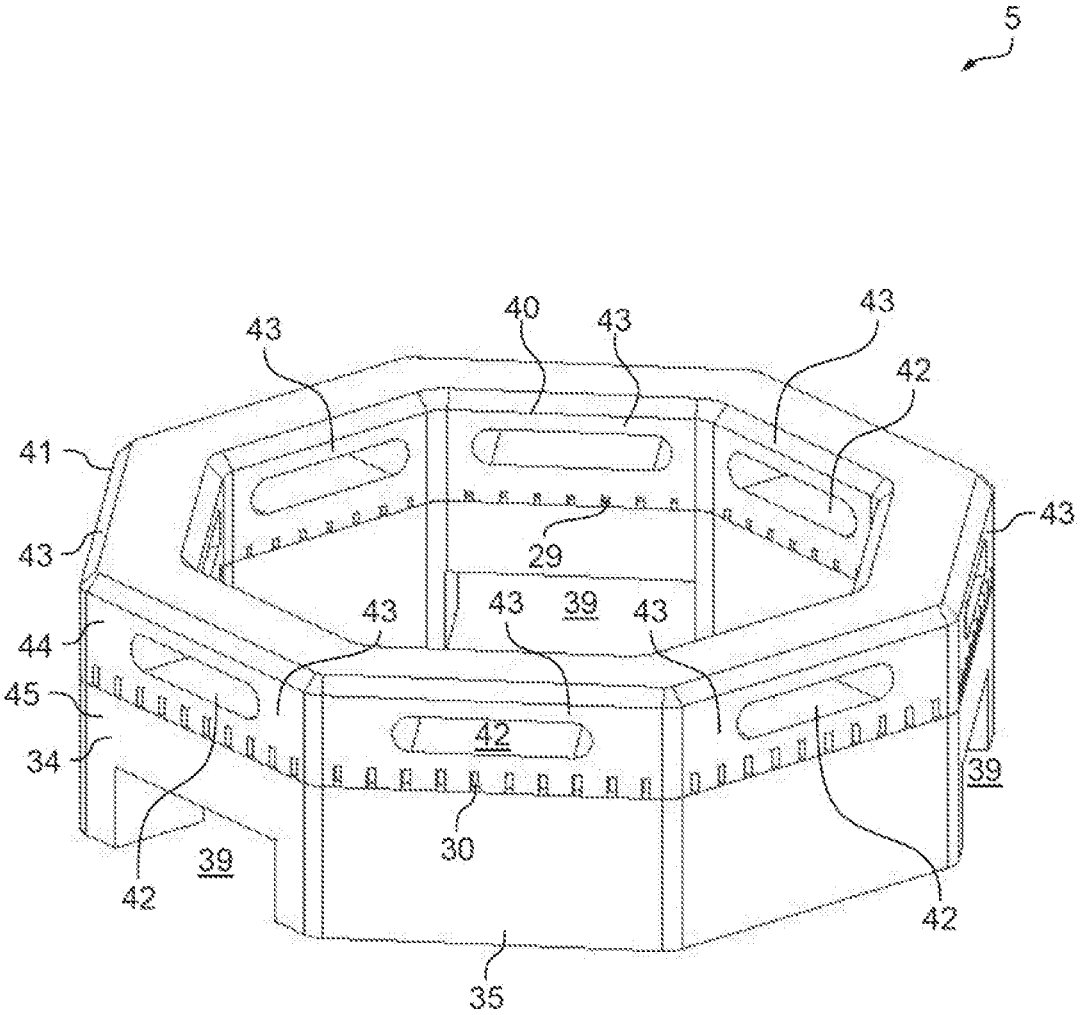
FIG. 9 shows schematically a perspective view of a further embodiment of the pan support for the gas stove according to FIG. 1.

FIG. 9 shows schematically a perspective view of a further embodiment of the pan support 5, 6 for the gas stove 1 according to FIG. 1. In contrast to FIG. 6, the pan support 5 has an octagonal shape when looking from above. Preferably, an inner contour 40 and/or an outer contour 41 has an octagonal shape when looking from above. The octagonal ring portion 34 comprises eight straight segments 43 formed to the octagonal shape. Further, ring shaped chamber 47 (not shown), in particular, has an octagonal shape when looking from above.

Figure 10:
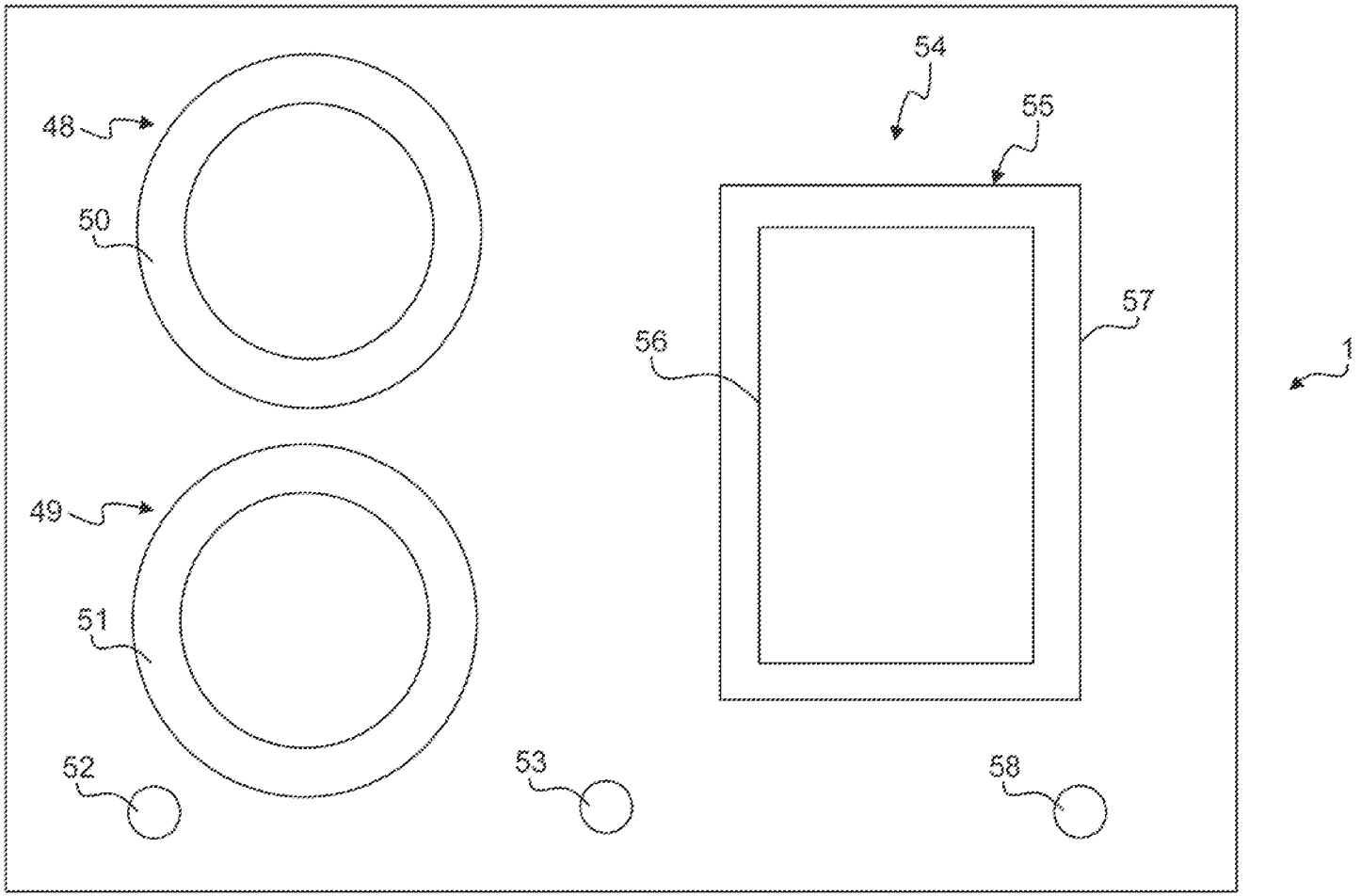
FIG. 10 shows a top view of a further embodiment of the gas stove.

FIG. 10 shows a further embodiment of the gas stove 1. The gas stove 1 comprises cooking zones 48, 49 having round pan supports 50, 51 when looking from above. It is assumed that a user stands in front of the gas stove 1 at the side with operating elements 52, 53, 58. The cooking zone 48 is arranged behind the cooking zone 49. The cooking zones 48, 49 can be operated by means of the operating elements 52, 53 that couple to a control device (not shown) for controlling the heating power of the respective burners/cooking zones 48, 49. Further, a cooking zone 54 is provided on the right of the cooking zones 48, 49. The cooking zone 54 comprises a rectangular pan support 55 when looking from above. Preferably, the pan support 55 has a rectangular inner edge 56 and a rectangular outer edge 57 forming a (rectangular) ring shape when looking from above. In particular, the pan support 55 has an elongated shape when looking from above and is configured to support an elongated pan 13, 14, in particular a roaster. Moreover, an operating element 58 is provided for operating the cooking zone 54. All features described for the pan support 5 apply mutatis mutandis for the pan support 55 and or the pan support 50 and/or the pan support 51.

The disclosed embodiments of pan supports include interior gas channels that transport gas to the gas openings. The pan supports combine the functions of a burner with a support for pans or pots. Hence, in comparison to conventional burner pan support combinations less elements are needed. In addition, a gas stove provided with the proposed pan supports meet advanced aesthetic demands and can be easier cleaned. Top sheets need less through-holes because separate burner openings can be omitted.

Although the present invention has been described in accordance with preferred embodiments, it is obvious for the person skilled in the art that modifications are possible in all embodiments. The materials mentioned can be altered.

The invention claimed is:

1. A pan support for a gas stove, said pan support comprising:

a support structure having a support surface for a pan;

a chamber section integrated inside the support structure for conducting a gas, said chamber having a circumferential geometry when looking from above;

a pillar portion protruding downwards from the support structure and having a bottom face that is in physical contact with the gas stove; and at least one vertically-arranged pipe portion disposed within the pillar portion for receiving and/or mixing the gas, the gas being received through a connection in the bottom face of the pillar portion;

wherein the support structure has gas outlet openings in fluid connection with the chamber section.

2. The pan support of claim 1, wherein the support structure surrounds a space and is configured to receive a wok at least partially in the space.

3. The pan support of claim 1, wherein the support structure has a circular, rectangular, hexagonal, or octagonal shape when looking from above.

4. The pan support of claim 1, wherein the support structure comprises a ring portion and pillar portions extending from the ring portion.

5. The pan support of claim 4, wherein the pillar portions protrude downwards and/or upwards from the ring portion.

6. The pan support of claim 4, wherein the gas outlet openings are provided at the ring portion and/or the pillar portions.

7. The pan support of claim 4, wherein the chamber section extends in the ring portion and the pillar portions.

8. The pan support of claim 4, wherein the gas outlet openings comprise inner gas outlet openings facing inwards and/or outer gas outlet openings facing outwards.

9. The pan support of claim 8, wherein the support structure comprises a first chamber for a first gas portion of the gas and a second chamber for a second gas portion of the gas, said first chamber being isolated from the second chamber.

10. The pan support of claim 9, wherein the inner gas outlet openings are fluid connected with the first chamber and the outer gas outlet openings are fluid connected with the second chamber.

11. The pan support of claim 1, wherein the support surface for the pan comprises an inclined surface which is inclined relative to a horizontal plane.

12. A gas stove comprising a pan support, said pan support comprising a support structure having a support surface for a pan, a chamber section integrated inside the support structure for conducting a gas, said chamber section having a circumferential geometry when looking from above, a pillar portion protruding downwards from the support structure and having a bottom face that is in physical contact with the gas stove; and at least one vertically-arranged pipe portion disposed within the pillar portion for receiving and/or mixing the gas, the gas being received through a connection in the bottom face of the pillar portion; wherein the support structure has gas outlet openings in fluid connection with the chamber section.

13. The gas stove of claim 12, further comprising a top sheet having a through-hole, said at least one vertically-arranged pipe portion of the pan support configured to protrude at least partially into the through-hole via the connection in the bottom face of the pillar portion.

14. A method comprising producing a pan support as set forth in claim 1 by a 3D-printing process.

15. The method of claim 14, wherein the 3D-printing process includes selective laser melting.

* * * * *